United States Patent [19]

Ruffle et al.

[11] Patent Number: 4,719,860

[45] Date of Patent: Jan. 19, 1988

[54] ARMOR-PENETRATING AMMUNITION ASSEMBLY WITH MOLDED PROTECTIVE CAP

[75] Inventors: Paul D. Ruffle, Edina; Randall L. Schiestl, Brooklyn Park; Robert L. Bonde, Minneapolis, all of Minn.

[73] Assignee: Honeywell Inc., Minneapolis, Minn.

[21] Appl. No.: 7,852

[22] Filed: Jan. 28, 1987

[51] Int. Cl.[4] ..... F42B 13/16

[52] U.S. Cl. ..... 102/521; 102/703

[58] Field of Search ..... 102/293, 501, 517–528

[56] References Cited

U.S. PATENT DOCUMENTS 3,446,147 5/1969 Engel et al. ..... 102/522

3,927,618 12/1975 Engel ..... 102/522

*Primary Examiner*—Harold J. Tudor

*Attorney, Agent, or Firm*—E. W. Hughes; R. W. Jensen

[57] ABSTRACT

An armor-penetrating projectile assembly 10 is provided with a molded protective cap 28. The cap 28, which is preferably molded from Nylon 6/6, is provided with a plurality of longitudinal stress grooves 34 formed in the interior surface of the cap 28 for aiding cap break-up as the projectile assembly 10 exits the muzzle of a cannon, and with an integral centering band 32 for ensuring a desired fit of the projectile assembly 10 inbore and, to control the angular velocity of the cap 28 about its axis of symmetry 46 for better separation after being fired. The cap 28 is fastened to the sabot 18 of the projectile assembly 10 by means of a grooved extension 36 on the sabot 18 within which a plurality of ramped projections 38 of cap 28 are received. The ramped projections 38 are molded into the inner surface of the cap 28 aft of each window 40. The windows 40 and ramped projections 38 permit the cap 28 to be readily separated from the mold in which cap 28 is formed using a pull mold even when cap 18 is formed of a high strength non-resilient material such as Nylon 6/6.

9 Claims, 5 Drawing Figures

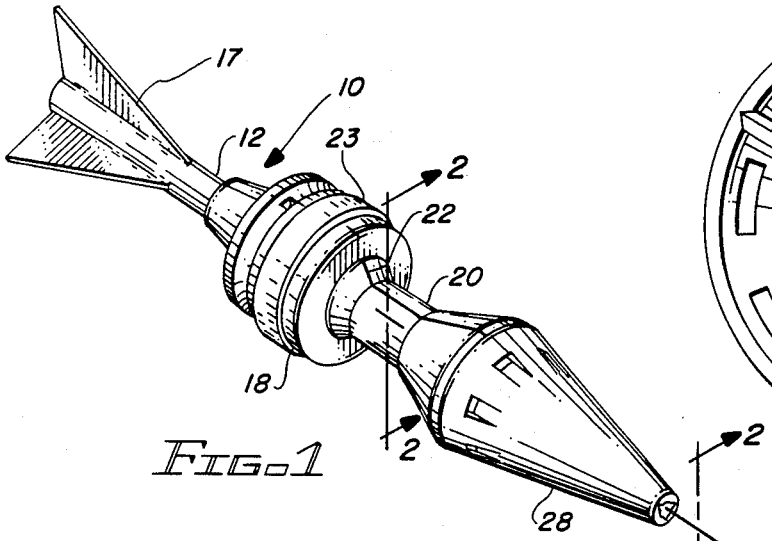
FIG. 1
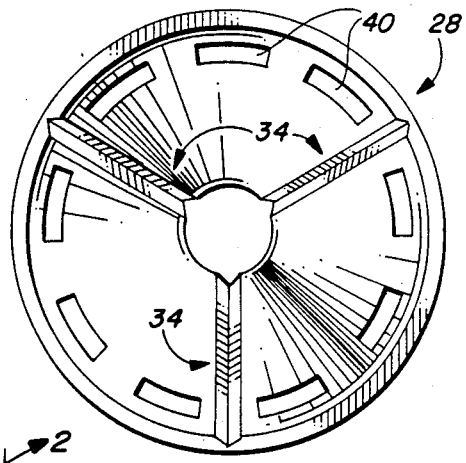
FIG. 5
FIG. 2
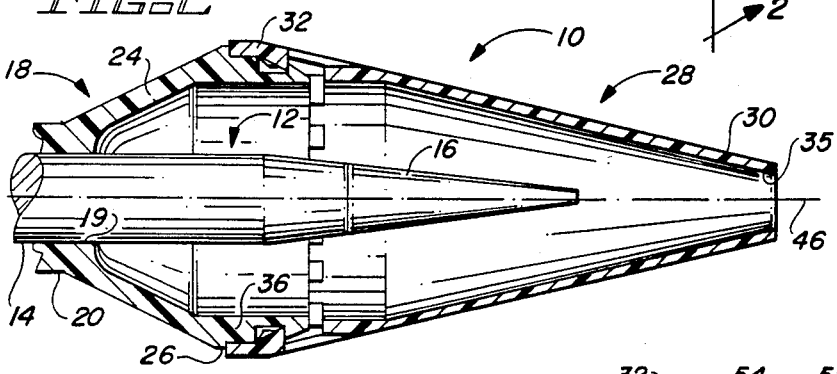
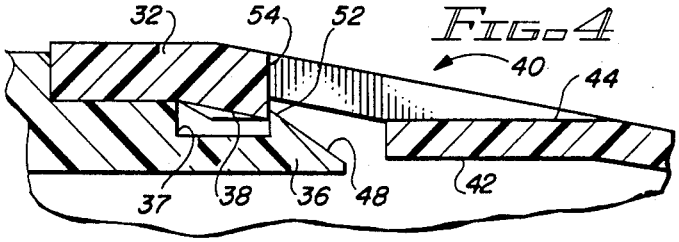
FIG. 4
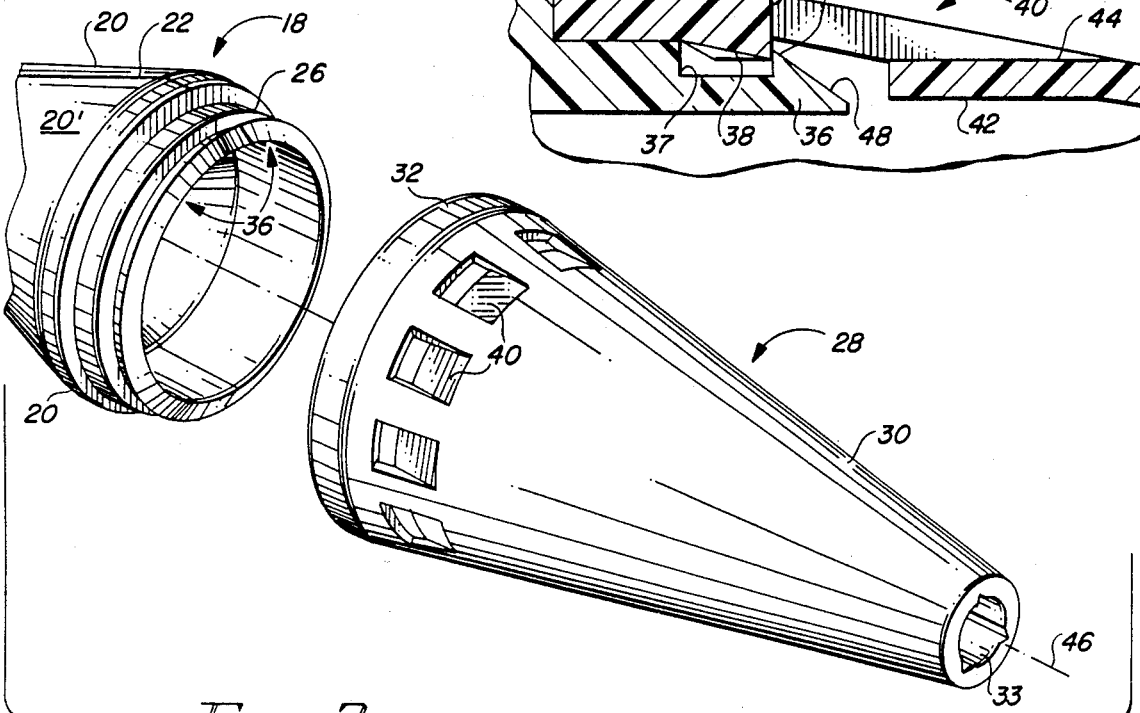
FIG. 3

ARMOR-PENETRATING AMMUNITION ASSEMBLY WITH MOLDED PROTECTIVE CAP

The Government has rights in this invention pursuant to Contract No. DAKK10-82-C-0296, awarded by the Department of the Army.

BACKGROUND OF THE INVENTION

1. Field of the Invention

This invention is in the field of protective caps for small caliber Armor-Penetrating Fin-Stabilized Discarding-Sabot (APFSDS) ammunition. The purpose of such caps is to protect the tapered front end of the fin stabilized penetrator from any damage during rough handling and to guide the front of the cartridge during feeding and chambering in an automatic cannon so that the trajectory of the penetrator does not deviate significantly from its predicted trajectory.

2. Description of the Prior Art

Conventional small-caliber APFSDS ammunition consists of a fin-stabilized, armor-piercing penetrator which is supported on the bore of an automatic cannon by means of a multiple segment sabot. Typically, the penetrator has a cylindrical body portion measuring approximately 8.3 mm in diameter, and a leading portion which tapers to a fine point for low aerodynamic drag. It is crucial that the point of the penetrator be well-protected, since mishandling can result in the point becoming dented, scratched or bent. Damage of this nature is clearly undesirable, since any irregularities in the streamlined surface of the penetrator will seriously impair the accuracy of the projectile or increase its aerodynamic drag, or both, and thus cause its trajectory to deviate significantly from its predicted trajectory which assumes that the leading, or tapered, portion of the penetrator will not be dented, scratched, or bent.

To prevent such damage from occurring, the ammunition assembly is normally provided with a one-piece protective cap which is fastened to the front end of the sabot. The cap protects the front end of the projectile during handling and provides a smooth surface at the forward end of the projectile so that the cartridge will readily feed and chamber in an automatic cannon. In addition, the cap is designed to separate from the sabot and the sabot from the projectile as the projectile exits the muzzle of the cannon in such a way that neither the cap nor the sabot interferes with the flight of the penetrator.

In the past, one-piece protective caps have been molded from polyethylene. Typically, the caps are molded with a reduced-diameter section enabling them to be snap-fit over a cooperating lip portion of the sabot. When a cartridge fitted with one of these caps is fired from an automatic cannon, a combination of air ram pressure and centrifugal force causes the cap to split and detach from the sabot, hopefully without interfering with the trajectory of the penetrator.

It has been found, however, that the conventional polyethylene caps do not function as effectively as desired. They have been known to separate prematurely from the sabot during rough handling, leaving the penetrator unprotected. At other times, they have failed to separate properly, or have fragmented in such a way as to disturb the trajectory of the penetrator. If these events happen, the accuracy and effectiveness of the ammunition is significantly impaired.

Therefore, a need exists for a new and improved protective cap for small caliber APFSDS ammunition, which provides better protection of the penetrator during handling, and which breaks apart "cleanly" at muzzle exit, to avoid causing the penetrator to deviate from its desired trajectory or to reduce the penetrators terminal velocity, and thus its ability to penetrate a target.

SUMMARY OF THE INVENTION

The present invention overcomes the shortcomings of the prior art by providing an improved protective cap, which is molded from a thermoplastic material having relatively high strength and stiffness such as NYLON 6/6. Materials having such characteristics permit the cap to withstand rough handling much better than a polyethylene cap. In addition, the cap of this invention is provided with longitudinal stress lines which assist in cap break-up. The rear portion of the cap is formed with an integral centering band, larger in diameter than the circular front end of the sabot. This ensures a better, or more controlled, fit of cap in-bore and produces better accuracy. In addition, the band can be designed to partially engage the barrel rifling to give added spin to the cap, thus increasing the centrifugal force experienced by the cap at muzzle exit. This results in improved cap separation, which in turn improves the degree to which the penetrator follows its predicted trajectory.

Another aspect of the invention is the novel fastening means which attached the protective cap to the sabot. The conventional snap fit used for polyethylene protective caps cannot be utilized with a cap molded from a thermoplastic material having a high tensile strength such as NYLON 6/6 because a cap cannot be molded from such materials with a completely circumferential inwardly extending projection or shoulder of reduced diameter. As a result, the cap is formed with a plurality of windows each of which receives a portion of the edge or lip of a circumferential cooperating projection of the sabot. The lip of the circumferential projection on the sabot snaps into each window and engages an extension of a vertical wall of each window in the cap to positively retain the cap on the sabot.

BRIEF DESCRIPTION OF THE DRAWINGS

The invention will be better understood from the following description when read in conjunction with the following drawings, wherein:

FIG. 1 is a perspective view of a small caliber, armor penetrating, fin stabilized, discarding sabot projectile, with the sabot being provided with the protective cap of this invention.

FIG. 2 is a section taken on line 2—2 of FIG. 1.

FIG. 3 is a perspective view showing the protective cap and the grooved forward portion of the sabot in exploded relation.

FIG. 4 is an enlarged fragmentary view through the the grooved forward portion of the sabot and a window of the cap.

FIG. 5 is a rear elevation of the protective cap.

DETAILED DESCRIPTION OF THE DRAWINGS

The ammunition, or projectile assembly 10 includes an armor-piercing penetrator 12 a sabot 18, and protective cap 28. Penetrator 12 has a cylindrical body 14 and a pointed, or tapered, leading end 16 with stabilizing fins 17 secured to the rear end of penetrator 12. Penetrator 12 is supported in the bore of an automatic cannon by a multiple segment sabot 18 which, in the preferred embodiment, has two substantially identical mating portions, or segments 20, 20' symmetrical about parting line 22. When assembled about penetrator 12, sabot 18 forms a continuous structure with its two segments 20, 20' being held together by obturating band 23. Sabot 18 has a flared forward portion 24 with a circular front end 26. It should be noted that the outer diameter of obturating band 23, which is made of a suitable plastic material is such that the lands of the rifling of the barrel from which it is fired are fully engraved into band 23 when munition 10 exits the gun barrel from which it is fired.

Fastened to the front end of sabot 18 is a molded protective cap 28 having a conical leading portion 30, a cylindrical trailing portion 32, and a circular opening 33 at the forward end of portion 30. The cylindrical trailing portion 32 forms an integral centering band which has an outer diameter which is greater than the outer diameter of the front end 26 of the sabot 18. The outside diameter of centering band 32 should be great enough to allow band 32 to engage the rifling in the bore of the gun barrel from which the munition is fired, resulting in the lands of the rifling being partially engraved into band 32. This degree of engagement between the centering band and the bore of the cannon or gun adds spin to cap 28 for improved separation at muzzle exit. In addition, cap break-up is improved by the provision of longitudinal stress grooves 34 formed in the inner conical surface 35 of conical leading portion 30. Grooves 34 extend for the length of cap 28, from the cylindrical centering band 32 to the opening 33 of cap 28. Preferably, stress grooves 34 are three in number, spaced at 120° intervals around the cap. Each groove 34 consists of two surfaces cut into the conical protective cap. The angle between the two surfaces is preferably approximately 90°.

NYLON 6/6 has been found to be a suitable material from which to form protective cap 28. Its relatively high strength and stiffness enable it to withstand rough handling better than its polyethylene predecessors. However, it is not possible, using conventional molds, to mold a continuous reduced diameter portion at the rear end of protective cap 28 for snap fitting onto the sabot. Thus, the need for a new fastening means for securing a nylon protective cap to a sabot.

The fastening means consists of an extension 36 on the forward portion 24 of sabot 18 in which is formed a circumferential groove 37. Extension 36 projects forwardly of the circular front end 26 of sabot 18, and is engaged by a series of ramped projections 38 of protective cap 28. In the preferred embodiment there are nine projections 38. Associated with each projection 38 is a window 40 formed by approximately shaped projections on the inner surface of the outer portion of the mold utilized to fabricate cap 28. As is best illustrated in FIG. 4, the window 40 associated with each ramped projection 38, is formed by inwardly bent, or deflected, wall segment 42. This structural arrangement permits cap 28 to be readily separated from its mold without any interference from ramped projections 38. It should be noted that the outer surface 44 of wall segment 42 is substantially parallel to the longitudinal axis, or axis of symmetry 46 of cap 28, and the most inwardly projecting portion of projection 38 lies substantially in the plane defined by surface 44.

Extension 36 of sabot 18 has an angular, or sloped, portion 48 and groove 37 just rearward of sloped portion 48 as is best seen in FIG. 4. Projection 38 is received in recess 37, with the outer portions, or lip, 52 of portion 48 and the intersecting wall defining groove 37 projecting into a cap window 40 and in contact with wall 54 of each window 40. The innermost portion of wall 54 is formed by ramped projection 38. This structural arrangement secures cap 28 to sabot 18 as long as cap 28 remains intact. Cap 28 will not split along stress grooves 34 while the lands of the barrel of a cannon engage centering band 32. However, as soon as projectile 10 exits the barrel of the cannon from which it is fired, cap 28 fractures, or splits, along stress grooves 34 into three substantially equally sized segments which clear penetrator 12 in such a manner as not to interfere with penetrator 12 following its predicted trajectory.

While the principles of the invention have now beed made clear in the illustrated embodiment, there will be immediately obvious to those skilled in the art, many modifications of structure, arrangements, proportions, the elements, materials, and components used in the practice of the invention, and otherwise, which are particularly adapted for a specific environments and operation requirements, without departing from those principles. The appended claims are therefore intended to cover and embrace any such modifications within the limits only of the true spirit and scope of the invention.

We claim as our invention:

1. An armor-penetrating projectile assembly 10 for an automatic cannon having a rifled barrel comprising:

a cylindrical penetrator 12 having a pointed leading end 16;

a discarding sabot 18 for positioning said penetrator 12 in a bore of a barrel of an automatic cannon, said sabot 18 having a cylindrical portion 19 defining a bore for receiving said penetrator 12, a flared intermediate portion 24, and a circular front end 26;

a one piece protective cap 28 molded from a thermoplastic material, said cap having an open ended conical leading portion 30, a cylindrical rear portion 32 forming an integral centering band having an outer diameter which is greater than the outer diameter of the circular front end 26 of the sabot 18, a substantially conical inner surface 35, and a plurality of stress concentrating grooves 34 formed in the inner surface 35 of the cap 28 and extending longitudinally through both the cylindrical rear portion 32 and conical portions 30 of the cap 28 for assisting in cap break-up when said assembly 10 is fired from a cannon; and fastening means including cooperating elements 52 on the forward portion 24 of said sabot 18 and 54 on the rear portion of said protective cap 28, said cooperating elements 52, 54 securing said cap 28 to said sabot 18 until the sabot 18 exits from the barrel of a cannon from which it is fired, said fastening means including an extension 36 forward of the circular front end 26 of the sabot 18, said extension 36 having a sloping forward portion 48, a groove 37 rearward of said sloping forward portion 48, the sloping portion 48 and groove 37 defining a lip 52; a plurality of windows 40 formed in said conical leading portion 30 of the protective cap 28; and ramped projections 38 proximate the cylindrical rear portion 32 of the cap 28 and formed on the inner surface 35 of the cap 28 rearwardly of each window 40; the lip 52 of the forward portion 48 of the sabot 18 projecting into the windows 40 of the protective cap 28, and the ramped projections 38 of the cap 28 being received in the groove 37 of the sabot 18 to secure the cap 28 to the sabot 18.

2. The armor-penetrating projectile assembly of claim 1, in which the ramped projections 38 of the cap 28 are spaced at regular intervals about an axis of symmetry 46 of the cap 28.

3. The armor-penetrating projectile assembly of claim 2, in which said grooves 34 are three in number, and are spaced at intervals of 120° from one another.

4. The armor-penetrating projectile assembly of claim 3, in which said protective cap 28 is molded from NYLON 6/6.

5. A molded protective cap 28 molded from a thermoplastic material for an armor-penetrating projectile assembly 10, said assembly 10 including a penetrator 12 and a discarding sabot 18 for positioning said projectile assembly 10 in an automatic cannon having a rifled barrel, said sabot 18 having a projection 36 at its forward end, said projection 36 having a sloping portion 48, a recess 37 adjacent the sloping portion 48, said sloping portion 48 and recess 37 defining an edge 52, said cap 28 comprising:

an open-ended conical leading portion 30 having an inner substantially conical surface 35;

a cylindrical rear portion 32 formed as an integral centering band for providing a predetermined degree of engagement between the cap 28 and the rifled bore of said automatic cannon;

a plurality of stress-concentrating grooves 34 molded into the inner surface 35 of the cap 28 and extending longitudinally through both the conical 30 and the cylindrical 32 portions of the cap 28 for assisting in cap break-up when said assembly 10 exits said cannon; and fastening means on said rear portion of the cap 28 for mounting the cap 28 on the sabot 18, said fastening means including a plurality of windows 40 formed in the conical leading portion 30 proximate the intersection of the cylindrical rear portion 32 with the conical leading portion 30 of the cap 28, a ramped projection 38 formed on the inner surface 35 of the conical portion 30 rearwardly of each window 40, said ramped projection 38 forming a portion of a wall 54 defining each window, each of said windows 40 receiving a portion of the edge 52 of the forward sloping portion 48 of the projection 36 of the sabot 28, the edge 52 engaging said portion 54 of said wall.

6. The protective cap of claim 5, in which said windows 40 are nine in number, and are spaced at regular intervals about a longitudinal axis 46 of the cap.

7. The protective cap of claim 6, in which said grooves 34 are three in number, and are spaced at intervals of substantially 120° from one another.

8. The protective cap of claim 7, in which the cap 28 is molded from NYLON 6/6.

9. The protective cap of claim 8, in which said integral centering band 32 has an outer diameter which is greater than the inner diameter of the rifling of the barrel.

* * * * *